US006340308B1

(12) United States Patent
Sugita

(10) Patent No.: US 6,340,308 B1
(45) Date of Patent: Jan. 22, 2002

(54) ELECTRICAL CONNECTOR

(75) Inventor: Naoki Sugita, Kanagawa (JP)

(73) Assignee: Kel Corporation, Tokyo (JP)

( * ) Notice: Subject to any disclaimer, the term of this patent is extended or adjusted under 35 U.S.C. 154(b) by 0 days.

(21) Appl. No.: 09/456,087

(22) Filed: Dec. 6, 1999

(30) Foreign Application Priority Data

Dec. 11, 1998 (JP) ..... 10-352634

(51) Int. Cl.[7] ..... H01R 13/62
(52) U.S. Cl. ..... 439/326; 439/636
(58) Field of Search ..... 439/62, 326–329, 439/629, 630, 636

(56) References Cited

U.S. PATENT DOCUMENTS 5,425,651 A * 6/1995 Thrush et al. ..... 439/326
5,525,071 A * 6/1996 Obara et al. ..... 439/326
5,695,354 A * 12/1997 Noda ..... 439/326
5,816,838 A * 10/1998 Del Prete et al. ..... 439/326
6,053,757 A * 4/2000 Turnbull ..... 439/326

* cited by examiner

*Primary Examiner*—Hien Vu
(74) *Attorney, Agent, or Firm*—Robert W. J. Usher

(57) ABSTRACT

A plurality of signal contact grooves 21 are provided in a laterally extending row, each groove opening through the front surface of a rear wall 11 of a housing 10. In each of the signal contact grooves 21, a first signal-transmission contact 30 and a second signal-transmission contact 40 are mounted in a front and rear pair. The second arm portions 44 of the second signal-transmission contacts 40, which are positioned rearward, are positioned above and extend longer than the second arm portions 34 of the first signal-transmission contacts 30, which are positioned forward. As a result, the contact portions 35 and 45 of the first and second signal-transmission contacts 30 and 40 are aligned in upper and lower rows in front of the front surface of the rear wall 11. This design is advantageous in reducing the number of steps necessary for the production of the signal-transmission contacts of the connector, and it also makes the mounting of the contacts into the housing easy, improving productivity.

7 Claims, 8 Drawing Sheets

ELECTRICAL CONNECTOR

FIELD OF THE INVENTION

The present invention relates to an electrical connector which is used for information exchange with a card-like memory module, such as a miniature card, which has a plurality of flat contacts for signal transmission on its surface.

BACKGROUND OF THE INVENTION

An example of card-like memory module of the type mentioned above, which has a plurality of flat contacts arranged on a surface for signal transmission, is a miniature card which is made smaller than a conventional IC card and is used as memory, for example, in a small size computer. As shown in FIG. 10, the miniature card 70 is a plate-like rectangular form and includes three power-supply contacts 71 and first and second grooves 72 and 73, each having a different width. The first groove 72, which is wider, is used to position the miniature card correctly in the housing of a connecter, into which the miniature card is inserted. The second groove 73, which is narrower, is to prevent accidental insertion into a connector which has a different voltage rating other than the one rated for the miniature card. For a miniature card whose voltage rating is different, the second groove 73 is provided at a different position. Therefore, the miniature card 70 can be inserted into only those connectors which have a right voltage rating. The miniature card 70 further includes a plurality of signal-transmission contacts 75, which are fixed in the laterally extending two rows of contact-mounting grooves 74 that are provided near the lower end 70*a* on the rear surface 70*b* of the miniature card 70. Furthermore, near the contact-mounting grooves 74 and on the lateral sides of the card, recesses 76 are provided for engagement.

The miniature card 70 is installed into an electrical connector of a computer, which connector comprises a plurality of signal-transmission contacts in a plate-like housing. In this installed condition, the signal-transmission contacts 75 and the power-supply contacts 71 of the miniature card 70 are in contact with the corresponding signal-transmission contacts and the corresponding power-supply contacts of the connector and ready for information exchange with the computer. In the installation of the miniature card 70 into the connector, at first, the lower end 70*a* of the miniature card 70 is inserted obliquely into a groove which is provided in the housing of the connector, and the power-supply contacts 71 of the miniature card 70 are pressed onto the power-supply contacts of the connector which are provided in the groove. Then, the miniature card 70 is turned around the lower end 70*a* thereof to bring the miniature card 70 substantially parallel to the housing of the connector. As a result, the signal-transmission contacts 75 of the miniature card 70 are brought into contact with the signal-transmission contacts of the connector. In this condition, the miniature card 70 is retained securely in the housing of the connector and is locked therein by a locking mechanism which is provided on the housing. In general, the signal-transmission contacts of the connector are mounted in contact grooves which are provided in the housing of the connector, such that the signal-transmission contacts extend parallel to the length of the housing for a certain distance, and then the contact portions which are provided at the front ends of the signal-transmission contacts come out of the housing for electrical contact, each bending in a Z-shape.

A so-called horizontally mounted connector is such a connector which is mounted in the front and rear direction horizontally on a printed circuit board. In this connector, the contact portions of the signal-transmission contacts are aligned in two front and rear rows, protruding upward from the upper surface of the housing. The first signal-transmission contacts whose contact portions are aligned in the front row and the second signal-transmission contacts whose contact portions are aligned in the rear row are mounted into the housing from the front side and the rear side of the housing, respectively. In this case, the lead portions of the first signal-transmission contacts extend forward from the lower surface of the housing while the lead portions of the second signal-transmission contacts extend rearward from the lower surface of the housing. In another example of horizontally mounted connector, the first signal-transmission contacts and the second signal-transmission contacts are mounted into the housing being interchanged one after another from the front end of the housing in a laterally extending zigzag pattern, and all the lead portions of the first and second signal-transmission contacts extend in the same direction (to the front side ). In this case, the second signal-transmission contacts are formed longer than the first signal-transmission contacts, and the top ends of the second signal-transmission contacts are bent laterally in a Z shape, so that the contact portions of the second signal-transmission contacts are positioned rearward than those of the first signal-transmission contacts.

On the other hand, a vertically mounted connector, i.e., the above described connector which is mounted vertically on a printed circuit board, requires the contact portions of the signal-transmission contacts to be aligned in two upper and lower rows while the lead portions of all the signal-transmission contacts must be extended downward. This requirement makes it impossible for the signal-transmission contacts to be mounted into the housing both from the upper side and from the lower side of the housing. If the signal-transmission contacts whose ends are bent laterally in a Z shape as mentioned above are to be used, then each of the contacts must be produced individually because they cannot be produced together in a lot from a plate material in a single process. Such design for the contacts is not cost-effective.

SUMMARY OF THE INVENTION

It is an object of this invention to provide an electrical connector that reduces the number of steps involved for producing the signal-transmission contacts, which are easily mountable into the housing, thereby improving productivity.

The present invention provides an electrical connector which comprises a housing and a plurality of signal-transmission contacts (e.g., the first and second signal-transmission contacts 30 and 40 of the following embodiment). The housing comprises a rear wall, which extends substantially vertically, and a front wall, which is provided in front of and parallel with the lower part of the rear wall. The front wall is connected with the rear wall at the lateral sides of the walls. The signal-transmission contacts are arranged in parallel with one another in a laterally extending row in the rear wall, and each of the signal-transmission contacts has a contact portion at one end thereof, each contact portion protruding forward from the rear wall. In this connector, the housing is capable of receiving a card-like memory module (e.g., the miniature card 70 of the following embodiment), which is swung from an inserted position to an installed position in the housing for installation. The inserted position is defined as a condition where the memory module is tilted forward with the upper end thereof being positioned forward and the lower end thereof being shifted downward and inserted into and positioned in a groove that is defined between the rear wall and the front wall of the housing. The installed position is defined as a condition where the memory module is turned around the lower end thereof from the inserted position and is positioned substantially parallel with the rear wall. The memory module has a plurality of flat signal-transmission contacts arranged in a row on a flat surface thereof. When the memory module is brought into the installed position, the signal-transmission contacts of the memory module come into contact with the contact portions of the signal-transmission contacts of the connector. In the rear wall of the housing, a plurality of contact grooves (e.g., the signal contact grooves 21 of the following embodiment) are provided in a laterally extending row, each contact groove opening forward. Each of the signal-transmission contacts of the connector comprises an anchoring portion, a first arm portion, and a second arm portion. The anchoring portion is fixed in a corresponding contact groove of the housing, and the first arm portion extends upward from the anchoring portion. The second arm portion extends forward from the upper end of the first arm portion and has the contact portion at the forward end thereof. The signal-transmission contacts of the connector are mounted in plurality in a forward and rearward direction in each of the contact grooves, such that the second arm portion of the signal-transmission contact which is positioned rearward in each contact groove extends above and forward longer than the second arm portion of the signal-transmission contact which is positioned forward in the same contact groove. As a result, the contact portions are aligned in upper and lower rows in front of the rear wall.

In this design of the connector, a plurality of signal-transmission contacts are provided in each contact groove. Therefore, the number of contact grooves provided in the housing is substantially smaller than that of a similar type prior-art connector. Thus, the design of a metal mold which is used for forming the housing of the connector can be simplified. Also, in this connector, all the signal-transmission contacts are mounted into the housing from one side (i.e., the lower side) of the housing, so the mounting of the contacts into the housing is relatively easy. Furthermore, in the connector of the present invention, the signal-transmission contacts are not configured in a Z shape as the prior-art connector, so they can be produced in a large number in a lot from a plate material. Thus, the manufacturing steps can be simplified to improve productivity.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

DESCRIPTION OF THE PREFERRED EMBODIMENTS

Figure 1:
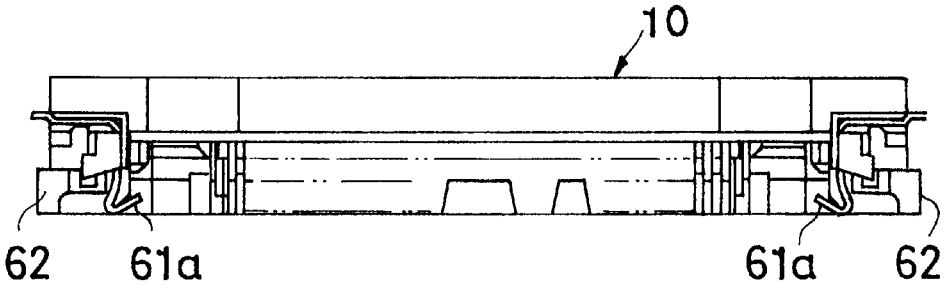
FIGS. 1A, 1B and 1C are a plan view, a front view and a bottom view, respectively, of an electrical connector according to the present invention.
Figure 1:
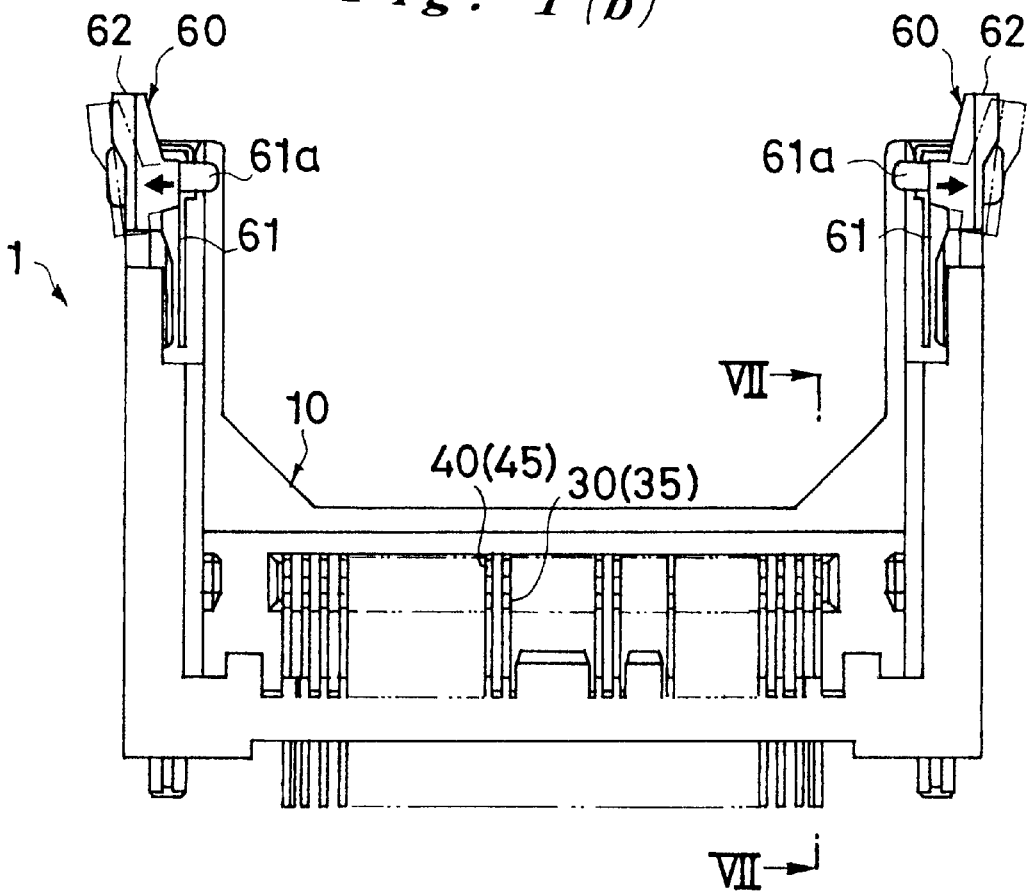
Figure 1:
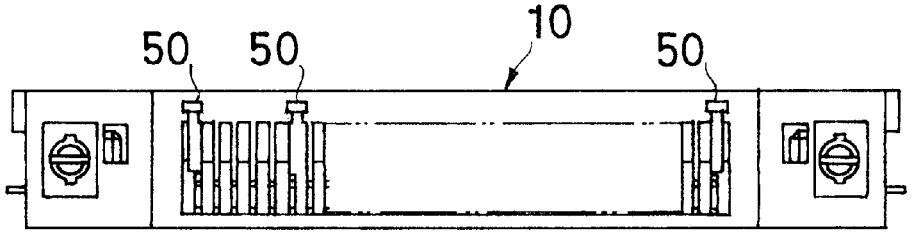
Figure 2:
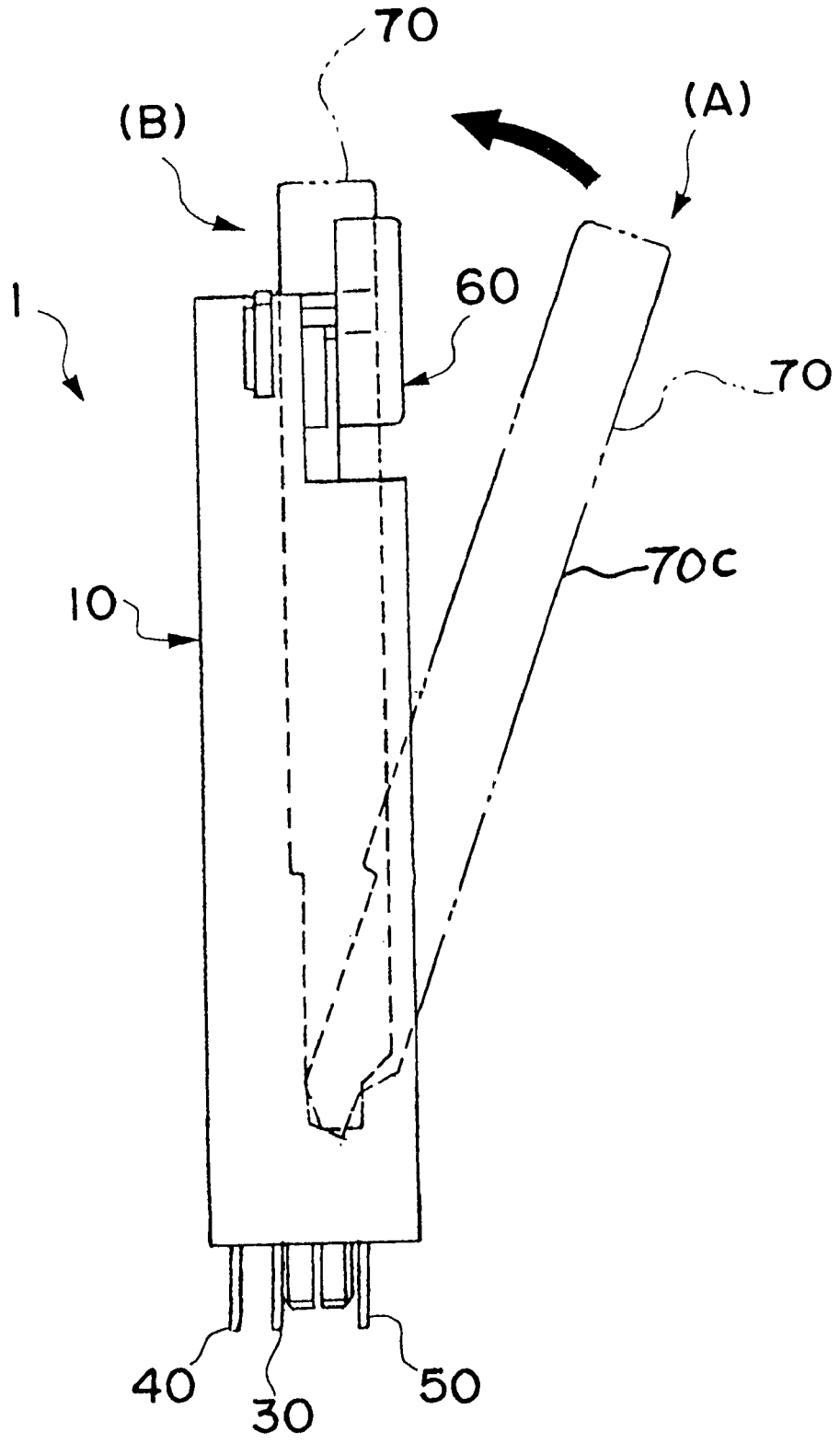
FIG. 2 is a side view of the connector, the two-dot chain line "A" in the figure indicating the position of a miniature card which is inserted into the connector while the two-dot chain line "B" indicating the position of the miniature card which has been installed.

FIG. 1 and FIG. 2 show an example of connector according to the present invention. This connector 1 comprises a housing 10, a plurality of contacts, and locking mechanisms 60, which are provided at the lateral sides of the housing 10. The housing 10 is integrally formed in a one-piece body of an insulative material such as plastics. The contacts comprise first and second signal-transmission contacts 30 and 40, which are formed of an electrically conductive material and are retained in the housing 10, and power-supply contacts 50, which are also formed of an electrically conductive material and are provided at three locations in the housing 10. As shown in FIG. 1B, the contact portions 35 of the first signal-transmission contacts 30 and the contact portions 45 of the second signal-transmission contacts 40 are aligned extending laterally in two upper and lower rows, respectively (the contact portions 35 are arranged in the lower row while the contact portions 45 are arranged in the upper row).

Figure 3:
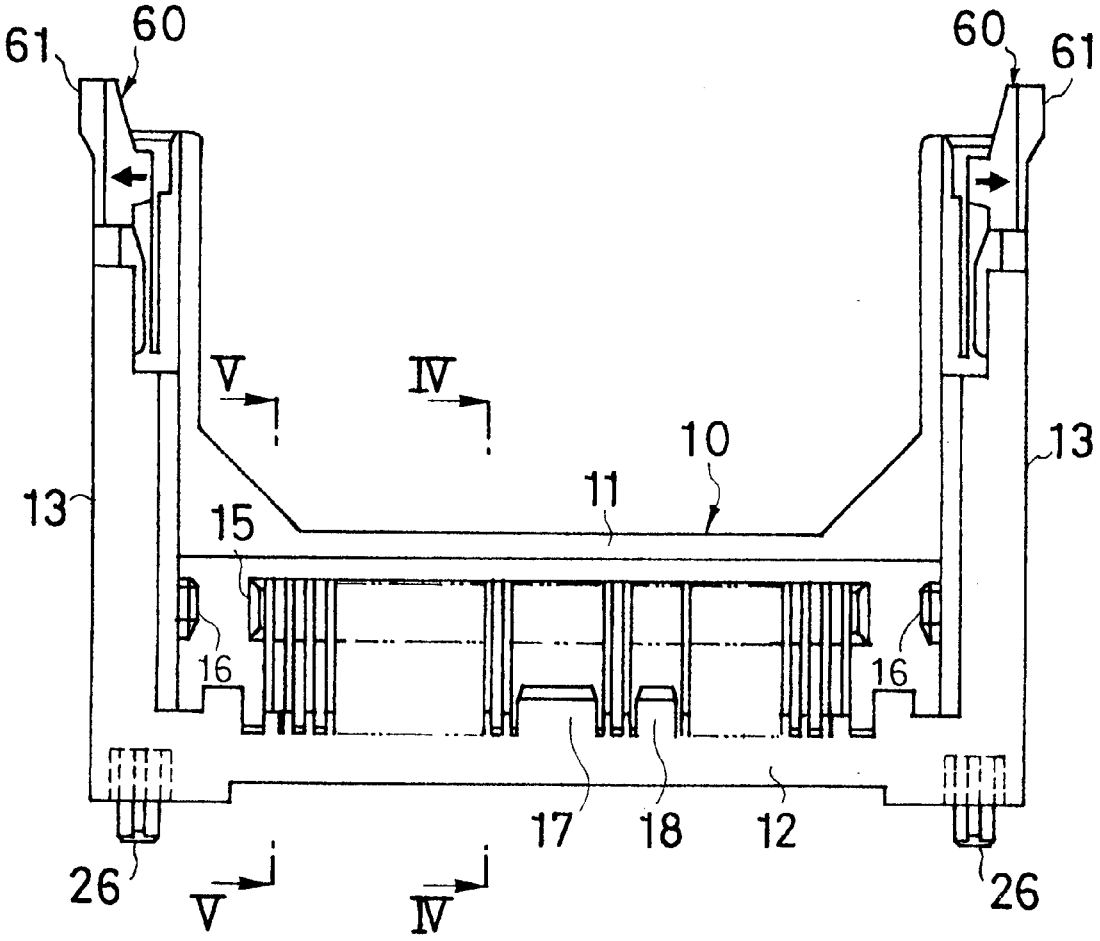
FIGS. 3A and 3B are a front view and a bottom view, respectively, of a housing which constitutes the connector.
Figure 3:
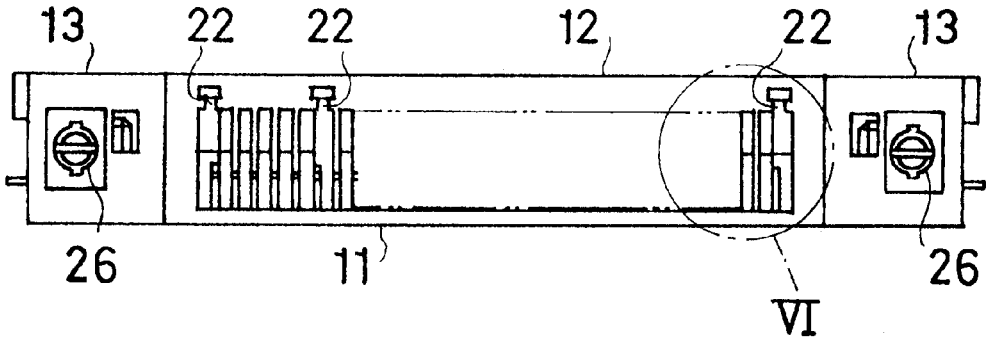
Figure 4:
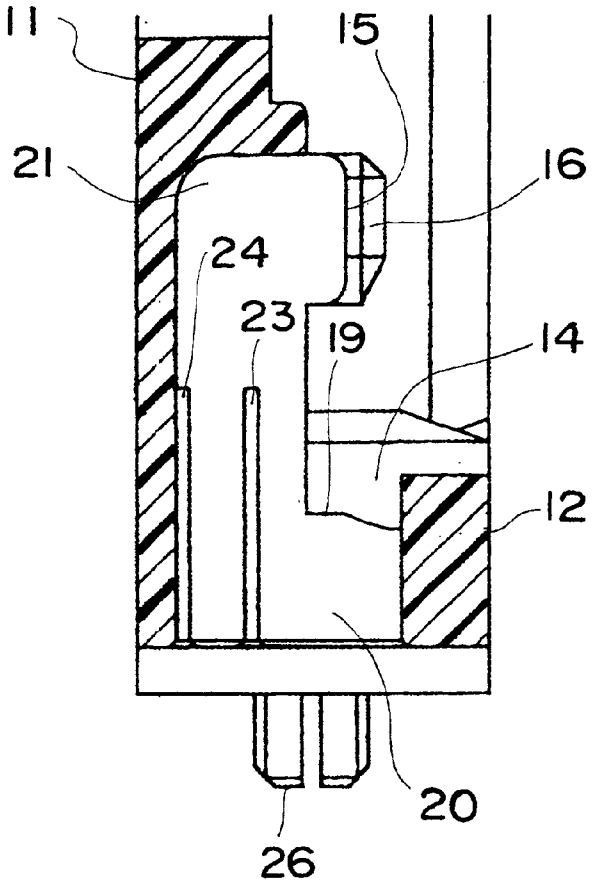
FIG. 4 is a sectional view of the housing, taken along line IV—IV in FIG. 3A.
Figure 5:
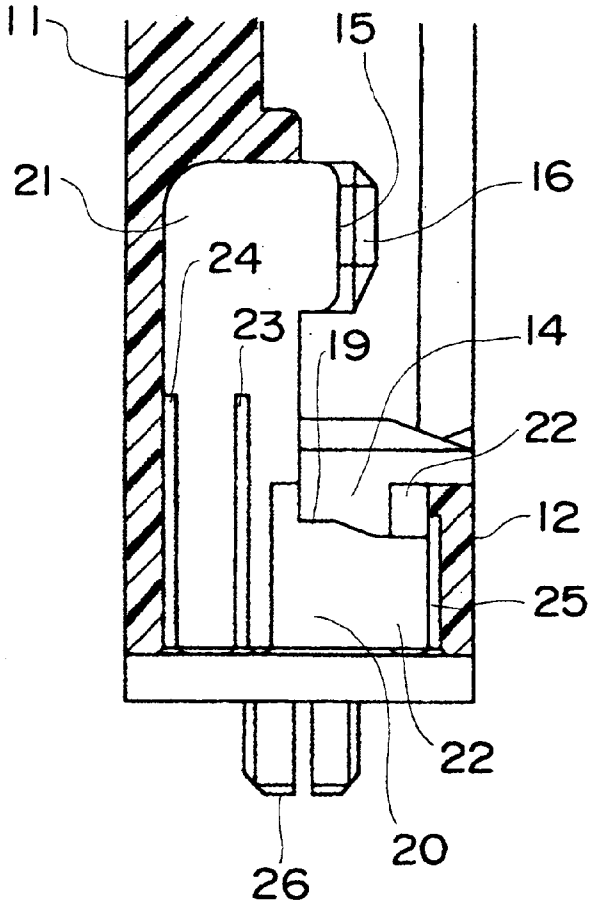
FIG. 5 is a sectional view of the housing, taken along line V—V in FIG. 3A.

As shown in FIGS. 3, 4 and 5, the housing 10 comprises a rear wall 11, which extends vertically, and a front wall 12, which faces the lower portion of the rear wall 11 in front of the rear wall 11, and lateral arms 13, which connect the rear and front walls 11 and 12 at the lateral ends of the walls 11 and 12 and extend upward. Therefore, as shown in FIGS. 4 and 5, a groove 14, which extends laterally and opens upward, is defined at the lower portion of the housing 10, between the rear wall 11 and the front wall 12. Furthermore, a raised portion 15 is provided protruding forward and extending laterally in the center on the front surface of the rear wall 11, and lateral raised portions 16 are provided protruding inward on the front surface of the rear wall 11 adjacently inside the lateral arms 13 at a position as high as the central raised portion 15. In addition, as shown in FIG. 3A, a first protrusion 17 and a second protrusion 18, which is narrower than the first protrusion 17, are provided next to each other at the upper end of the front wall 12.

Figure 6:
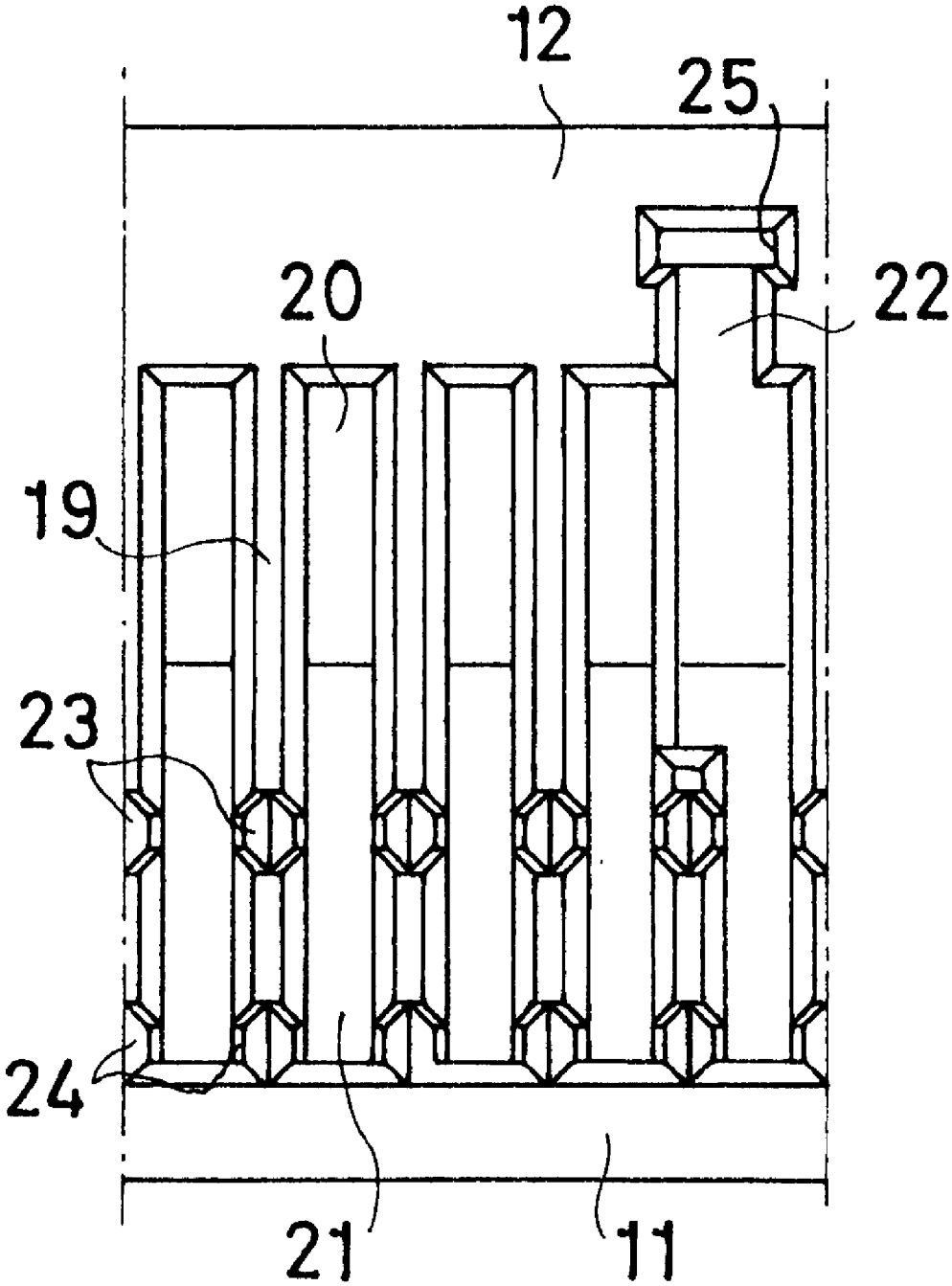
FIG. 6 is an enlarged view of the region indicated by circle VI in FIG. 3B.

As shown in FIG. 3B and FIG. 6, a plurality of plate-like portions 19 are provided parallel with one another, each spanning in the front and rear direction and connecting the rear wall 11 and the front wall 12 at the lower end of the groove 14. As a result, a slit 20, which extends in the front and rear direction, exists between every two neighboring plate-like portions 19. These slits 20 extend into the rear wall 11 and form signal contact grooves 21. As shown in FIG. 3B and FIG. 6, three of the slits 20 extend forward to form power contact grooves 22.

As shown in FIG. 4 through FIG. 6, in the signal contact grooves 21, first signal contact grooves 23 and second signal contact grooves 24 are provided, each first signal contact groove being aligned with a corresponding second signal contact groove in the front and rear direction, and each first and second signal contact groove widens in the lateral direction and extends in the up and down direction. Also, as shown in FIG. 5 and FIG. 6, in the power contact grooves 22, power contact mounting grooves 25 are provided, respectively, each widening laterally and extending in the up and down direction.

Figure 7:
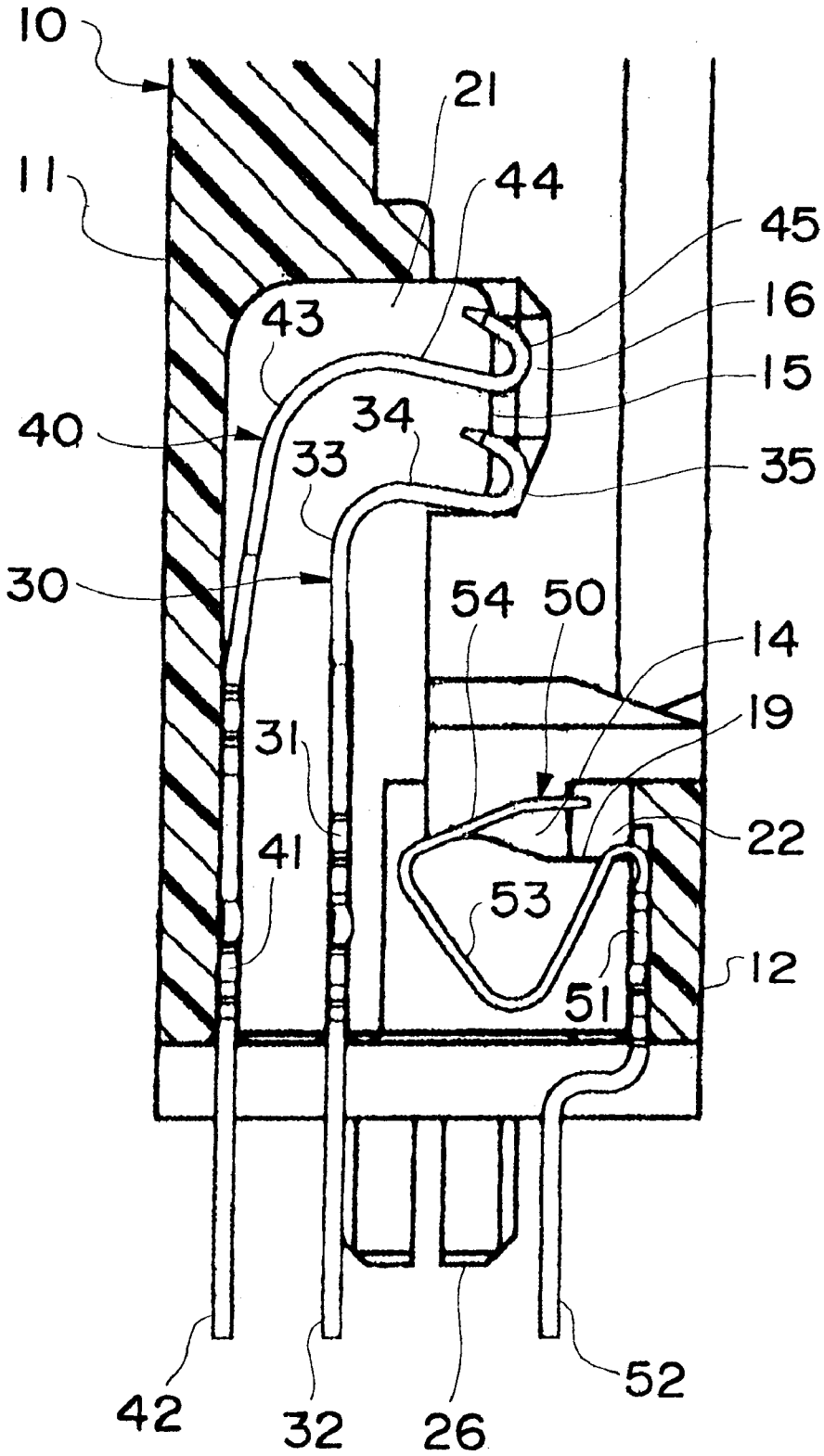
FIG. 7 is a sectional view of the connector, taken along line VII—VII in FIG. 1B.

As shown in FIG. 7, each of the first signal-transmission contacts 30 comprises an anchoring portion 31, a lead portion 32, a first arm portion 33, and a second arm portion 34. The anchoring portion 31 has a width wider than that of the first signal contact grooves 23 and is press-fit into one of the first signal contact grooves 23 (i.e., fixed in the housing 10). The lead portion 32 extends downward from the lower end of the anchoring portion 31 and protrudes downward out of the housing 10. The first arm portion 33 extends upward from the upper end of the anchoring portion 31, and the second arm portion 34 extends bending forward from the upper end of the first arm portion 33. At the forward end of the second arm portion 34, a contacting portion 35 is provided curling upward. This contact portion 35 protrudes forward beyond the front surface of the central raised portion 15. Because the width of the first and second arm portions 33 and 34 is narrower than that of the signal contact grooves 21, when a force is applied to the contact portions 35 from the front side of the connector, the contacts 30 bend elastically in the front and rear direction around the anchoring portions 31 in the signal contact grooves 21 and resist the force.

As shown in FIG. 7, each of the second signal-transmission contacts 40 comprises an anchoring portion 41, a lead portion 42, a first arm portion 43, and a second arm portion 44. The anchoring portion 41 has a width wider than that of the second signal contact grooves 24 and is press-fit into one of the second signal contact grooves 24 (i.e., fixed in the housing 10). The lead portion 42 extends downward from the lower end of the anchoring portion 41 and protrudes downward out of the housing 10. The first arm portion 43 extends upward from the upper end of the anchoring portion 41, and the second arm portion 44 extends bending forward from the upper end of the first arm portion 43. At the forward end of the second arm portion 44, a contacting portion 45 is provided curling upward. This contact portion 45 protrudes forward beyond the front surface of the central raised portion 15. Because the width of the first and second arm portions 43 and 44 is narrower than that of the signal contact grooves 21, when a force is applied to the contact portions 45 from the front side of the connector, the contacts 40 bend elastically in the front and rear direction around the anchoring portions 41 in the signal contact grooves 21 and resist the force. As shown in FIG. 7, the second arm portions 44 of the second signal-transmission contacts 40 are positioned above the second arm portions 34 of the first signal-transmission contacts 30, both second arm portions protruding forward as described above. In this condition, the first and second signal-transmission contacts 30 and 40 are fixed in the signal contact grooves 21 without interfering each other while their contact portions 35 and 45 are aligned in pairs of upper and lower contact portions.

As shown in FIG. 7, each of the power-supply contacts 50 comprises an anchoring portion 51, a lead portion 52, an arm portion 53, and a contact portion 54. The anchoring portion 51 has a width wider than that of the power contact mounting grooves 25 and is press-fit into one of the power contact mounting grooves 25 (i.e., fixed in the housing 10). The lead portion 52 extends rearward and then downward from the lower end of the anchoring portion 51 and protrudes downward out of the housing 10. The arm portion 53 extends obliquely rearward and downward from the upper end of the anchoring portion 51 and then extends obliquely rearward and upward. The contact portion 54 extends obliquely forward and upward from the upper end of the arm portion 53. The forward end of the contact portion 54 protrudes upward beyond the upper surface of the plate-like portions 19 in the groove 14. Because the width of the arm portions 53 and the contact portions 54 is narrower than that of the power contact grooves 22, when a force is applied to the contact portions 54 from the upper side of the connector, the contacts 50 bend elastically in the up and down direction around the anchoring portions 51 in the power contact grooves 22 and resist the force.

For mounting the first and second signal-transmission contacts 30 and 40 into the housing 10, firstly the second signal-transmission contacts 40 are inserted into the signal contact grooves 21 from the lower end of the housing 10, and the anchoring portions 41 of the contacts 40 are press-fit into the second signal contact grooves 24. Secondly, the first signal-transmission contacts 30 are mounted into the housing 10 in the same way by press-fitting the anchoring portions 31. For mounting the power-supply contacts 50 into the housing 10, the power-supply contacts 50 are inserted into the power contact grooves 22 from the lower end of the housing 10, and the anchoring portions 51 are press-fit into the power contact mounting grooves 25. In this way, the first and second signal-transmission contacts 30 and 40 and the power-supply contacts 50 are stitched into respective grooves all from the lower end of the housing 10. As described previously, the signal contact grooves 21 and the power contact grooves 22 are continuous to the slits 20, so the spaces of the slits 20 facilitates the mounting of the contacts 30, 40 and 50, which are inserted into the respective grooves 21 and 22.

As shown in FIG. 1, each of the locking mechanisms 60 comprises a fitting 61 and a releasing lever 62, which is mounted on the upper part of the fitting 61. The fittings 61 of the locking mechanisms 60 are fixed in the upper portions of the lateral arms 13, one locking mechanism for each arm. As shown in FIG. 1A, tabs 61*a* are provided extending inward and rearward at the upper parts of the fittings 61, which are bent forward.

The above described connector 1 is mounted vertically onto a printed circuit board (not shown), which is placed horizontally. The lead portions 32 and 42 of the first and second signal-transmission contacts 30 and 40 and the lead portions 52 of the power-supply contacts 50, which protrude downward, are inserted downward into corresponding through-holes which are provided on the printed circuit board. The through-holes are formed perpendicular to the printed circuit board and are plated with a metal. The lower ends of the lead portions 32, 42 and 52, which are in the through-holes, are then soldered onto the terminals of electrically conductive pathways of circuits which are provided on the lower surface of the printed circuit board. For the positioning of the connector 1 on the printed circuit board, positioning pins 26 are provided protruding downward on the lower surface of the housing 10 directly below the lateral arms 13, and these positioning pins are inserted into the holes which are provided on the printed circuit board for the positioning of the connector.

Figure 8:
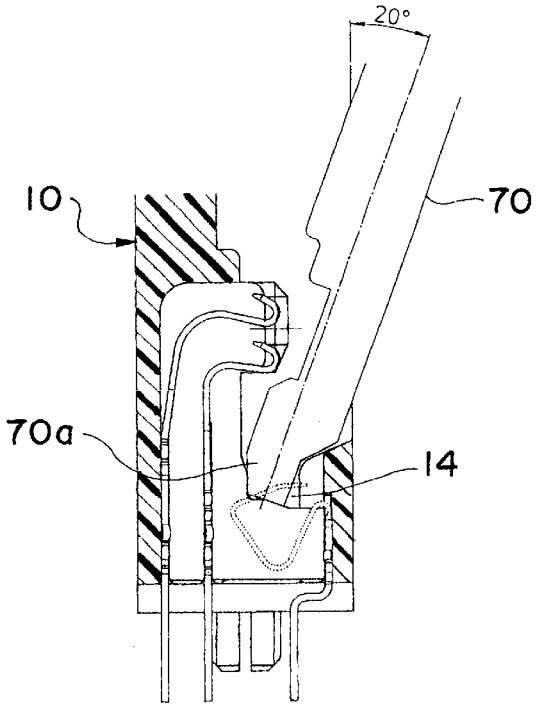
FIG. 8 shows a positional relation between the miniature card and the connector when the tilt angle of the miniature card is 20 degrees.
Figure 9:
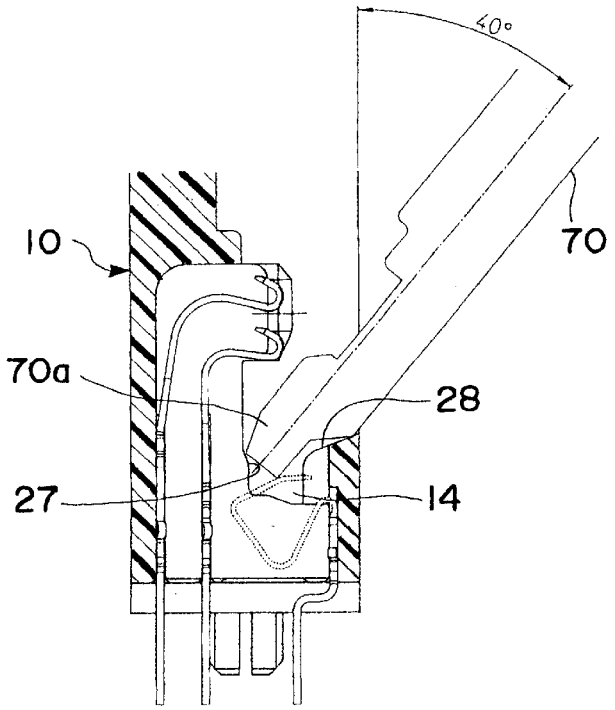
FIG. 9 shows a positional relation between the miniature card and the connector when the tilt angle of the miniature card is 40 degrees.
Figure 10:
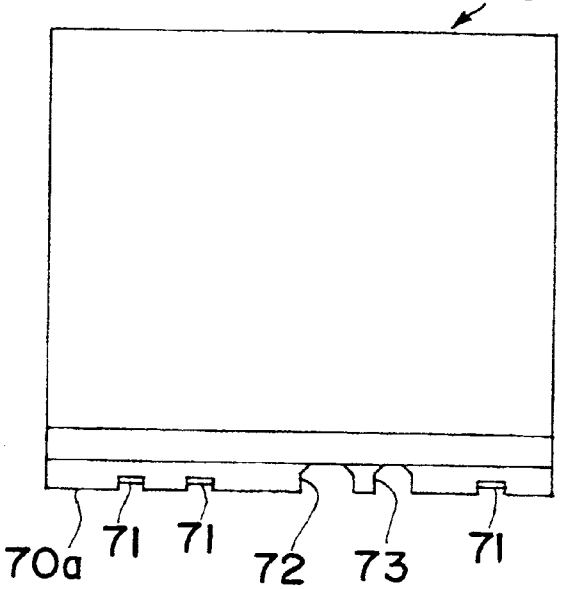
FIGS. 10A, 10B, 10C and 10D are a rear view, a side view, a front view and a bottom view, respectively, of the miniature card.
Figure 10:
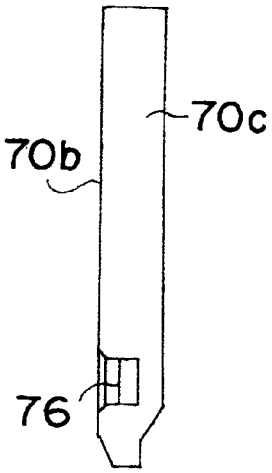
Figure 10:
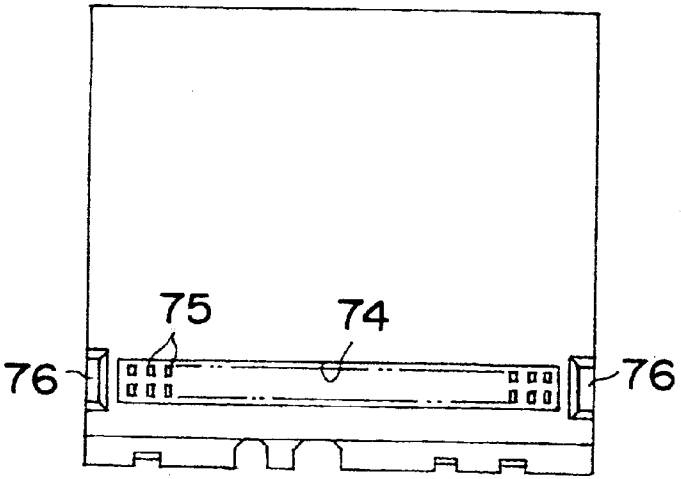
Figure 10:
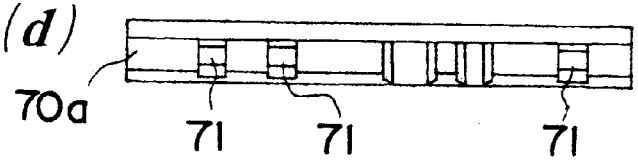

The above described miniature card 70 is releasably installed into this connector 1. In the installation of the miniature card 70 into the connector 1, firstly, the miniature card 70 is tilted and oriented such that the upper end thereof is positioned forward and the first and second grooves 72 and 73 thereof are facing the first and second protrusions 17 and 18, respectively, of the housing 10 of the connector. Secondly, the lower end 70*a* of the miniature card 70 is inserted into the groove 14 of the connector (refer to FIG. 8). During the insertion, the three power-supply contacts 71 of the miniature card 70, which contacts are provided at the lower end 70*a*, meet and push the three power-supply contacts 50 of the connector 1 downward. The position of the miniature card 70 in this condition, where the lower end 70*a* of the miniature card 70 is in the groove 14 of the housing 10 of the connector, is hereinafter referred to as "inserted position". FIG. 2A shows this inserted position. The tilting angle of the miniature card 70 (i.e., the angle to the vertical line) which is required for the insertion of the lower end 70*a* of the miniature card 70 into the groove 14 of the connector 1 is defined in a range between 20 and 25 degrees. If the tilting angle of the miniature card 70 is less than 20 degrees, then the lower end 70*a* of the miniature card 70 hits the central raised portion 15 or the front wall 12 of the housing 10 of the connector. On the other hand, if it is greater than 25 degrees, then the lower end 70*a* of the miniature card 70 does not go into the groove 14 of the connector (FIG. 9 shows the condition where the tilting angle is 40 degrees).

Then, the miniature card 70 is turned around the lower end 70*a* thereof from the above described inserted position into a vertical position by pushing the surface 70*c* of the miniature card 70 in the direction indicated by an arrow in FIG. 2. When the miniature card 70 comes close to the vertical position, the signal-transmission contacts 75 of the miniature card 70 meet and push the contact portions 35 and 45 of the first and second signal-transmission contacts 30 and 40 of the connector rearward. As a result, the first and second signal-transmission contacts 30 and 40 are deformed elastically rearward and acquire resiliency in the signal contact grooves 21, which resiliency generates reaction forces in the contacts whose contact portions are in contact with the corresponding contacts of the miniature card 70. In this condition, the lower end 70*a* of the miniature card 70 is pushed forward by the reaction forces, but it is held stationary by the rear surface of the front wall 12 of the housing 10 of the connector. Therefore, the miniature card 70 is turned further into the vertical position relatively easily against the resistance of the first and second signal-transmission contacts 30 and 40. In this condition, the front wall 12 of the housing is pushed forward by the lower end 70*a* of the miniature card 70, but the front wall 12 has a strength which is sufficient to withstand this pressure because it is connected firmly to the rear wall 11 of the housing 10 through the lateral arms 13 and the plate-like portions 19.

When the miniature card 70 is pushed further against the resistance of the first and second signal-transmission contacts 30 and 40, the lateral sides of the upper part of the miniature card 70 meet the tabs 61*a* of the locking mechanisms 60. As described previously, because the tabs 61*a* extend inward and rearward, when the miniature card 70 is pushed further, the tabs 61*a* (together with the releasing levers 62) are opened laterally outward by the lateral ends of the miniature card 70. When the miniature card 70 becomes substantially parallel with the rear wall 11 of the housing 10 (i.e., when it is almost vertical), the lateral recesses 76 of the miniature card 70 fit with the lateral raised portions 16 of the housing 10. At the same time, the tabs 61*a* of the locking mechanisms 60 are freed from the lateral ends of the miniature card 70 to come onto the surface 70*c* of the miniature card 70 because of the resiliency of the fittings 61 of the locking mechanisms 60. As a result, the miniature card 70 is held and locked by the locking mechanisms 60, and the installation of the miniature card 70 is complete. This position of the miniature card 70 in the housing 10 of the connector 1, which is shown in FIG. 2B, is hereinafter referred to as "installed position". In the installed position, the power-supply contacts 71 of the miniature card 70 are in contact with the power-supply contacts 50 of the connector 1, and the signal-transmission contacts 75 of the miniature card 70 are in contact with the first and second signal-transmission contacts 30 and 40 of the connector 1. In this condition, the miniature card 70 is ready for information exchange through the connector 1.

As described above, in the connector 1 according to the present invention, a plurality of signal-transmission contacts (i.e., a first signal-transmission contact 30 and a second signal-transmission contact 40) are mounted in each contact groove 21, so the contact grooves 21 are provided in the housing 10 in a relatively small number. This construction of the housing simplifies the design of a metal mold which is used for forming the housing. Also, in the connector 1 according to the present invention, all the signal-transmission contacts are mounted into the housing from the one side (i.e., the lower side) of the housing, so the contacts are mounted in the housing relatively easily. Furthermore, in the connector of the present invention, the first and second signal-transmission contacts 30 and 40 are not configured in a Z shape as required for a conventional connector. Therefore, the first and second signal-transmission contacts 30 and 40 can be produced in a large number in a lot, respectively, from a plate material. Thus, the number of manufacturing steps can be reduced to improve the productivity.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This application claims the priority of Japanese Patent Application No.10-352634 filed on Dec. 11, 1998, which is incorporated herein by reference.

What is claimed is:

1. An electrical connector comprising:

a housing molded In one piece from plastic material and comprising:

a rear wall, which extends substantially vertically, and a front wall, which is provided in front of and parallel with a lower part of said rear wall, and lateral arms connecting the front wall to the rear wall;

a series of plate-like members which extend vertically, forward and rearward, in parallel, spaced apart relation to each other in a laterally extending row and interconnect said front wall and said rear wall so that a groove for receiving the memory module is defined by the front wall, rear wall and upper ends of the plate-like members slits defined by pairs of adjacent plate-like members;

a raised portion is formed on a front surface of the rear wall at a laterally central location of said rear wall so as to protrude forward and extend laterally and the respective slits extend into the rear wall and into the raised portion to form signal contact grooves;

a plurality of first signal-transmission contacts having respective anchoring portions which are which are press-fitted in respective signal contact grooves so that the first signal-transmission contacts extend in a first laterally extending row in said rear wall, and a plurality of second signal-transmission contacts having respective anchoring portions which are press-fitted in respective signal contact grooves so that the second signal-transmission contacts extend in a second laterally extending row in said rear wall, each of said signal-transmission contacts having a first arm portion and a second arm portion, each first arm portion extending upwardly from a respective anchoring portion and each second arm portion extending transversely from a respective first arm portion and through the raised portion and having a contact portion at one end thereof which protrudes forward beyond the raised portion, respective contact portions of the first signal-transmission contacts being aligned below respective contact portions of the second signal-transmission contacts;

the first laterally extending row of first signal-transmission contacts being forward of the second laterally extending row of signal-transmission contacts with respective individual first signal-transmission contacts being aligned forward of and anchored in same respective individual signal contact grooves as respective individual second signal-transmission contacts so that two signal transmission contacts are anchored in the same of each signal contact groove, whereby a card-like memory module can be located in said housing in an initial, inserted position by inserting the card-like memory module, lower end leading, downward and rearward toward the rear wall until received in the memory module receiving groove with the memory module inclined forward, away from the rear wall at an acute entry angle and the memory module can be subsequently moved to an installed position in the housing by rotating an upper end of the memory card rearward until substantially parallel to the rear wall, said memory module having a plurality of flat signal-transmission contacts arranged in two rows on a flat surface thereof, and said signal transmission contacts of said memory module coming into contact with said contact portions of both said first signal-transmission contacts and said second signal-transmission contacts of said connector when said memory module is moved into said installed position, and wherein at least one mounting groove for retaining a third contact of said connector is provided adjacent the front wall on a side of the groove receiving the memory module which is opposite from the first and second contacts.

2. The connector as set forth in claim 1, wherein:

said signal-transmission contacts of said connector are inserted into and mounted in said contact grooves from a lower side of said housing.

3. An electrical connector comprising:

a housing molded in one piece from plastic material and comprising:

a rear wall, which extends substantially vertically, and a front wall, which is provided in front of and parallel with a lower part of said rear wall, and lateral arms connecting the front wall to the rear wall;

a series of plate-like members which extend vertically, forward and rearward, in parallel, spaced apart relation to each other in a laterally extending row and interconnect said front wall and said rear wall so that a groove for receiving the memory module is defined by the front wall, rear wall and upper ends of the plate-like members, slits defined by pairs of adjacent plate-like members;

a raised portion is formed on a front surface of the rear wall at a laterally central location of said rear wall so as to protrude forward and extend laterally and the respective slits extend into the rear wall and Into the raised portion to form signal contact grooves;

a plurality of first signal-transmission contacts having respective anchoring portions which are which are fixed by press-fitting in respective mounting grooves which extend vertically at front parts of each of said signal contact grooves so that the first signal-transmission contacts extend in a first laterally extending row in said rear wall, and a plurality of second signal-transmission contacts having respective anchoring portions which are fixed by press-fitting in respective mounting grooves at rear parts of each of said signal contact grooves so that the second signal-transmission contacts extend in a second laterally extending row in said rear wall, each of said signal-transmission contacts having a first arm portion and a second arm portion, each first arm portion extending upwardly from a respective anchoring portion and each second arm portion extending transversely from a respective first arm portion and through the raised portion and having a contact portion at one end thereof which protrudes forward beyond the raised portion, respective second arm portions of said second signal-transmission contacts being positioned above respective second arm portions of said first signal-transmission contacts so that contact portions of the second signal-transmission contacts and respective contact portions of the first signal-transmission contacts are aligned in upper and lower rows, respectively;

the first laterally extending row of first signal-transmission contacts being forward of the second laterally extending row of signal-transmission contacts with respective individual first signal-transmission contacts being aligned forward of and anchored in same respective individual signal contact grooves as respective individual second signal-transmission contacts so that two signal transmission contacts are anchored in the same of each signal contact groove, whereby a card-like memory module can be located in said housing in an initial, inserted position by inserting the card-like memory module, lower end leading, downward and rearward toward the rear wall until received in the memory module receiving groove with the memory module inclined forward, away from the rear wall at an acute entry angle and the memory module can be subsequently moved to an installed position In the housing by rotating an upper end of the memory card rearward until substantially parallel to the rear wall, said memory module having a plurality of flat signal-transmission contacts arranged in two rows on a flat surface thereof, and said signal transmission contacts of said memory module coming into contact with said contact portions of both said first signal-transmission contacts and said second signal-transmission contacts of said connector when said memory module is moved into said installed position, and wherein at least one mounting groove for retaining a third contact of said connector is provided adjacent the front wall on a side of the groove receiving the memory module which is opposite from the first and second contacts.

4. The connector as set forth in claim 3, wherein:

said signal-transmission contacts of said connector are inserted into and mounted in said contact grooves from a lower side of said housing.

5. The connector as set forth in claim 3, wherein at least one of said slits has a forward extension providing the contact mounting groove for retaining the third contact of said connector.

6. The connector as set forth in claim 5, wherein:

said contact mounting groove for said third contact extends vertically and said third contact is inserted into and mounted in said contact mounting groove from a lower side of said housing.

7. The connector as set forth in claim 4, wherein said third contact is a power-supply contact.

* * * * *